US008628062B2

(12) United States Patent
Alluru et al.

(10) Patent No.: US 8,628,062 B2
(45) Date of Patent: Jan. 14, 2014

(54) VEHICLE JACK ASSEMBLY

(76) Inventors: Raju Alluru, Northville, MI (US); Lester M. Fisher, Jr., Novi, MI (US); George W. Lukowski, Bloomfield Hills, MI (US)

( * ) Notice: Subject to any disclaimer, the term of this patent is extended or adjusted under 35 U.S.C. 154(b) by 1082 days.

(21) Appl. No.: 12/001,368

(22) Filed: Dec. 11, 2007

(65) Prior Publication Data

US 2008/0272349 A1 Nov. 6, 2008

Related U.S. Application Data

(60) Provisional application No. 60/927,654, filed on May 4, 2007.

(51) Int. Cl.
*B66F 3/08* (2006.01)

(52) U.S. Cl.
USPC ..... 254/126; 254/122

(58) Field of Classification Search
USPC ..... 254/126, 124, 122, DIG. 4, DIG. 1
See application file for complete search history.

(56) References Cited

U.S. PATENT DOCUMENTS

| | | | | | |
|---|---|---|---|---|---|
| 996,137 | A | | 6/1911 | Praeger | |
| 1,714,464 | A | | 5/1929 | Merriman | |
| 1,994,015 | A | | 3/1935 | Curran | |
| 3,159,368 | A | * | 12/1964 | Ahlbin et al. | 248/222.41 |
| 4,055,329 | A | | 10/1977 | Hammond | |
| 4,111,344 | A | | 9/1978 | MacDonald | |
| 4,249,685 | A | | 2/1981 | Sawby | |
| 4,583,713 | A | | 4/1986 | Fukura et al. | |
| 4,586,696 | A | | 5/1986 | Mugford et al. | |
| 4,629,163 | A | * | 12/1986 | Miller et al. | 254/133 R |
| 4,750,774 | A | | 6/1988 | Pickering | |
| 4,838,512 | A | | 6/1989 | Lisak et al. | |
| 4,848,733 | A | | 7/1989 | Yamauchi et al. | |
| 5,104,170 | A | | 4/1992 | Rich | |
| 5,118,083 | A | * | 6/1992 | Metzen | 254/126 |
| 5,139,232 | A | | 8/1992 | Bailey | |
| 5,165,660 | A | * | 11/1992 | Engel et al. | 254/126 |
| 5,176,362 | A | | 1/1993 | Seksaria et al. | |
| 5,199,688 | A | * | 4/1993 | Engel | 254/126 |
| 5,275,378 | A | | 1/1994 | Alten | |
| 5,346,180 | A | * | 9/1994 | Popowich | 254/126 |
| 5,364,072 | A | | 11/1994 | Engel | |
| 5,449,149 | A | * | 9/1995 | Popowich | 254/126 |
| 5,458,316 | A | * | 10/1995 | Engel | 254/126 |
| 5,893,494 | A | | 4/1999 | Charton | |

(Continued)

FOREIGN PATENT DOCUMENTS

| | | | |
|---|---|---|---|
| JP | 09-175283 | A | 7/1997 |
| KR | 20-2001-0001468 | U | 1/2001 |

*Primary Examiner* — Lee D Wilson
(74) *Attorney, Agent, or Firm* — Warn Partners, P.C.

(57) ABSTRACT

The present invention is a jack assembly having a first and second upper bracket pivotally connected to a support member and each having at least one strengthening bead and at least one rolled edge. A first lower bracket is pivotally connected to the first upper bracket using a non-threaded trunnion and a bearing through which a threaded rod extends. A second lower bracket is pivotally connected to the second upper bracket using a threaded trunnion through which the threaded rod also extends. The brackets are tapered for strength. The first and second lower brackets are pivotally connected to a base having an enclosed keyhole orifice for storage of the jack assembly. At least one strengthening flange is formed in both the first and second lower bracket.

18 Claims, 6 Drawing Sheets

(56) References Cited

U.S. PATENT DOCUMENTS

| | | | | |
|---|---|---|---|---|
| 5,894,974 | A | 4/1999 | Jensen | |
| 5,950,990 | A | 9/1999 | Castillo | |
| 5,988,594 | A | 11/1999 | Gill | |
| 6,070,856 | A | 6/2000 | Alten | |
| 6,227,428 | B1 | 5/2001 | Lewis et al. | |
| 6,634,688 | B2 * | 10/2003 | Foat et al. | 296/1.01 |
| 6,779,822 | B2 | 8/2004 | Foat et al. | |
| 7,434,784 | B2 * | 10/2008 | Tjader | 254/134.3 FT |
| 2008/0006800 | A1 * | 1/2008 | Kikuchi | 254/126 |
| 2008/0272349 | A1 * | 11/2008 | Alluru et al. | 254/126 |

* cited by examiner

VEHICLE JACK ASSEMBLY

FIELD OF THE INVENTION

The present invention relates to jack assemblies used in motor vehicles and a method for retaining the same in a stored position.

BACKGROUND OF THE INVENTION

Jack assemblies are commonly used when performing various types of repair work on motor vehicles. A jack is used for supporting a portion of the weight of a vehicle, while one or more of the vehicle wheels are lifted from a ground surface, allowing access to replace tires, brakes, or other vehicle components. Many vehicles store a vehicle jack in a spare-tire well and the like for the purpose of replacement of a tire if the vehicle tire is damaged.

One problem that commonly occurs with jacks used in the replacement of vehicle components is that their use can be cumbersome and unsafe. For example, a manually rotated rod for translating force to the lifting components of the jack can have an undesirable engagement location and be of an insufficient length to accommodate comfortable and safe operation of the jack. In addition, current jacks can lack structural integrity and strengthening features to ensure operation of the jack is safe. Another problem common with jacks is that an additional or separate attachment component is needed to retain the jack in a stored position when the jack is not in use. These additional attachment components are an additional cost to vehicle manufacturers and consumers, and the attachment components can become lost throughout the life of the vehicle which can necessitate replacement parts or result in undesirable lack of storage capability.

Accordingly, there exists a need for an improved jack assembly which overcomes the aforementioned problems.

SUMMARY OF THE INVENTION

The present invention is a jack assembly having a first upper bracket pivotally connected to a support member, a second upper bracket pivotally connected to the support member, a first lower bracket pivotally connected to the first upper bracket using a trunnion and a bearing at one end. A second end of the first lower bracket is pivotally connected to a base. Preferably, at least one bracket is tapered to provide added strength and rigidavity to the jack. The invention also includes a second lower bracket pivotally connected to the second upper bracket using a second trunnion at one end, and a second end of the second lower bracket is pivotally connected to the base. A threaded rod extends through the first trunnion and bearing, and the second trunnion.

When the threaded rod is rotated in a first direction, the trunnion will translate along the threaded rod toward said first trunnion, causing the first upper bracket to pivot relative to the support member and the first lower bracket, the second upper bracket to pivot relative to the support member and the second lower bracket, and the support member to move vertically away from the base.

When the threaded rod is rotated in a second direction, the second trunnion will translate along the threaded rod away from said first trunnion, causing the first upper bracket to pivot relative to the support member and the first lower bracket, the second upper bracket to pivot relative to the support member and the second lower bracket, and the support member to move vertically toward the base. To store the jack when not in use, a vehicle screw or bolt with an enlarged head and a narrower shaft is inserted through an enlarged opening of a fully enclosed keyhole orifice disposed in the base. The base is moved parallel to the vehicle until the narrower shaft is positioned fully within a narrower locking portion of the enclosed keyhole orifice.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
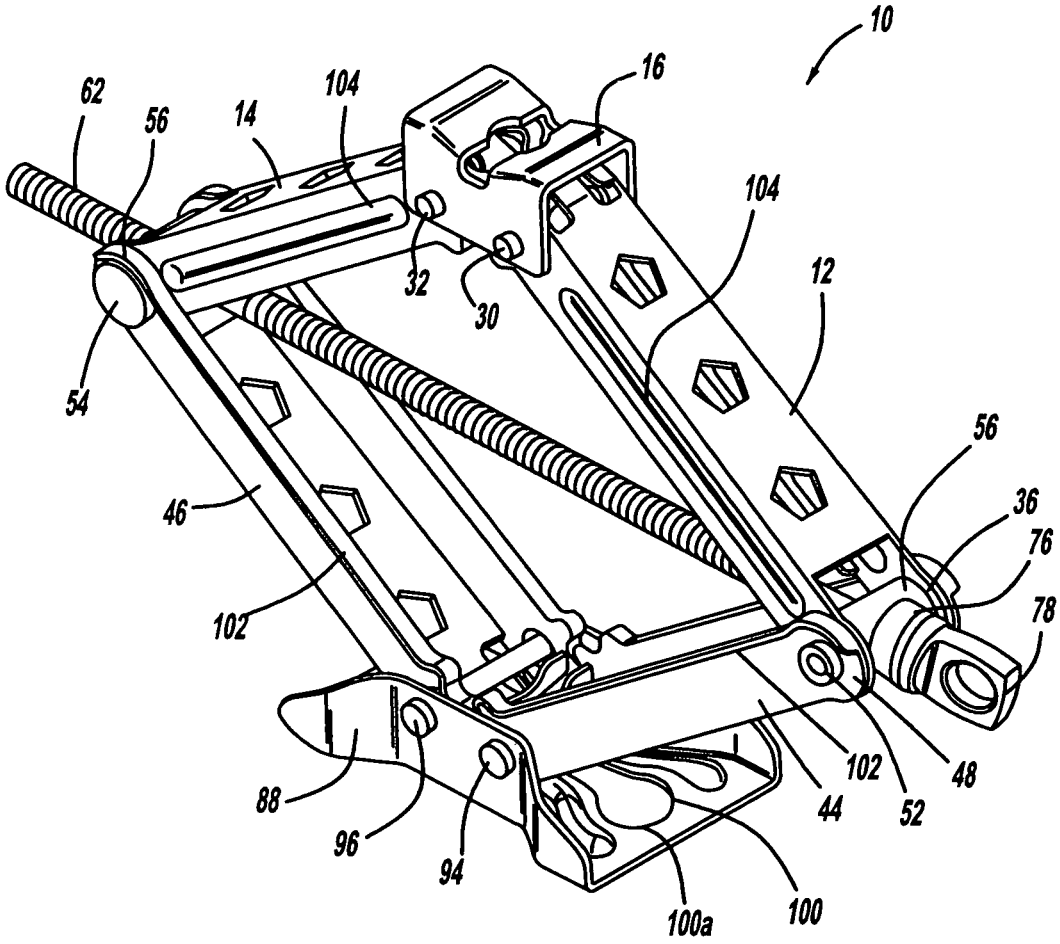
FIG. 1 is a perspective view of a jack assembly; according to the present invention.
Figure 2A:
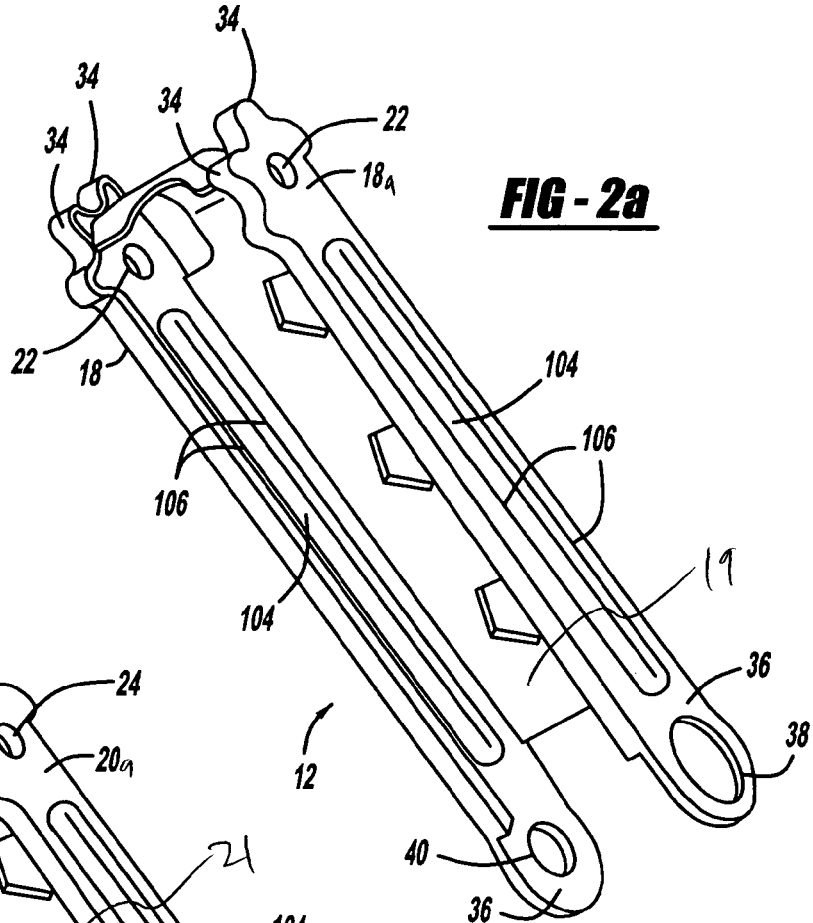
FIG. 2*a* is a perspective view of a first upper bracket used in a jack assembly, according to the present invention.
Figure 2B:
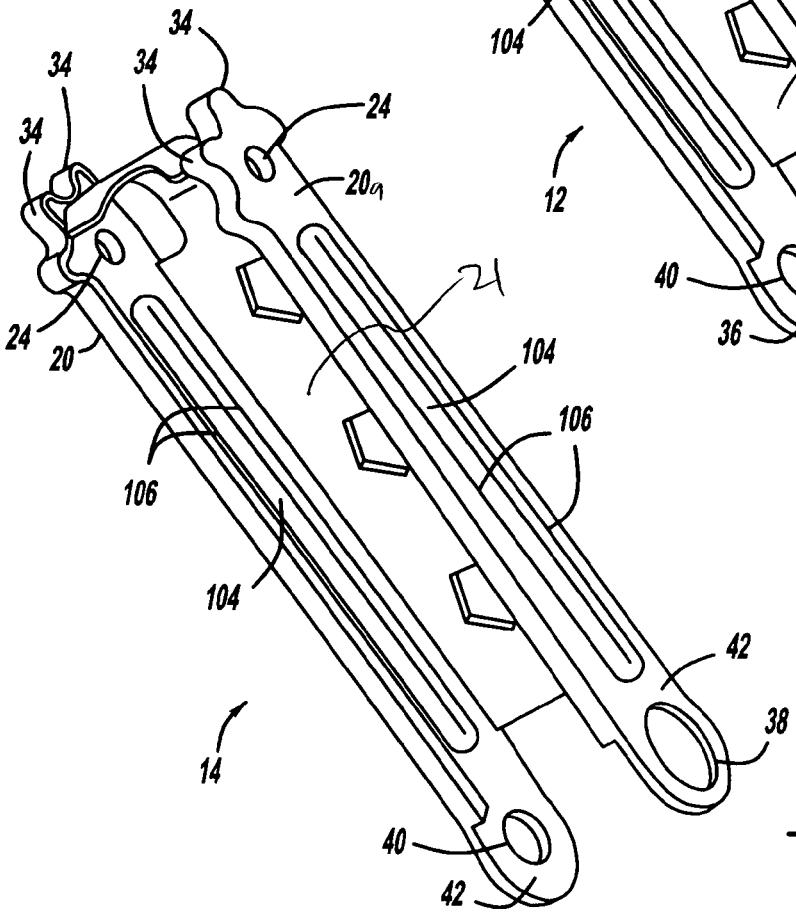
FIG. 2*b* is a perspective view of a second upper bracket used in a jack assembly, according to the present invention.
Figure 3:
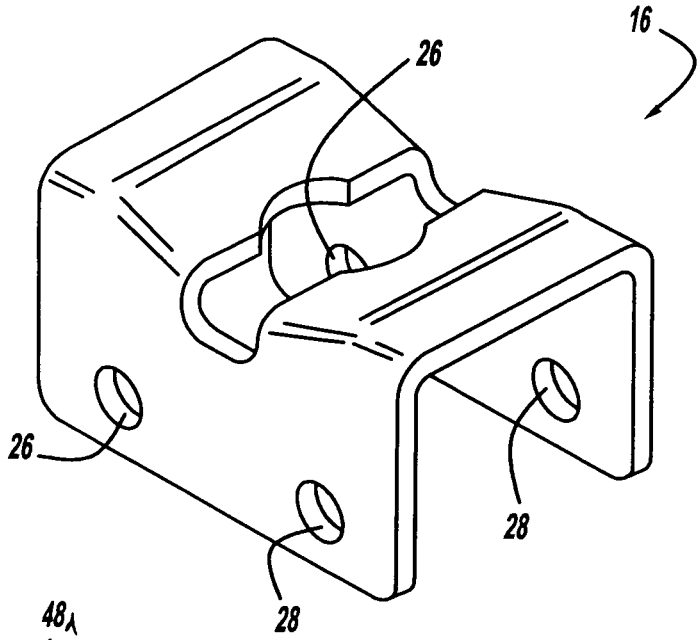
FIG. 3 is a perspective view of a support member used in a jack assembly, according to the present invention.
Figure 4A:
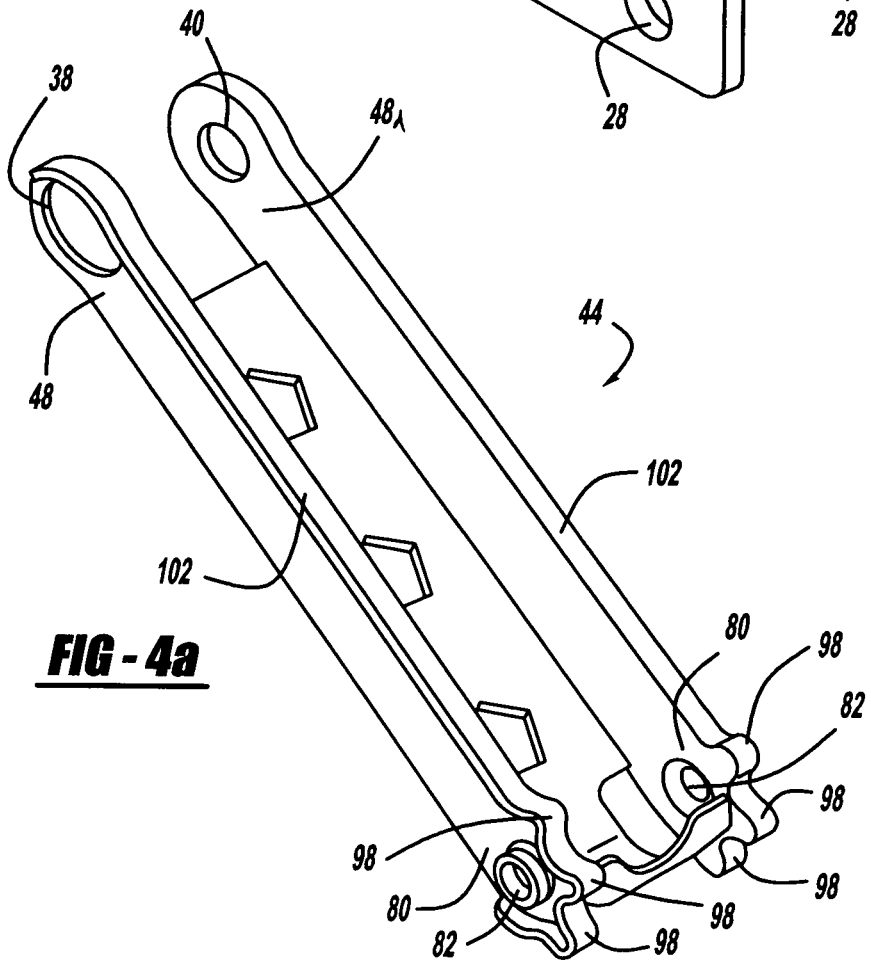
FIG. 4*a* is a perspective view of a first lower bracket used in a jack assembly, according to the present invention.
Figure 4B:
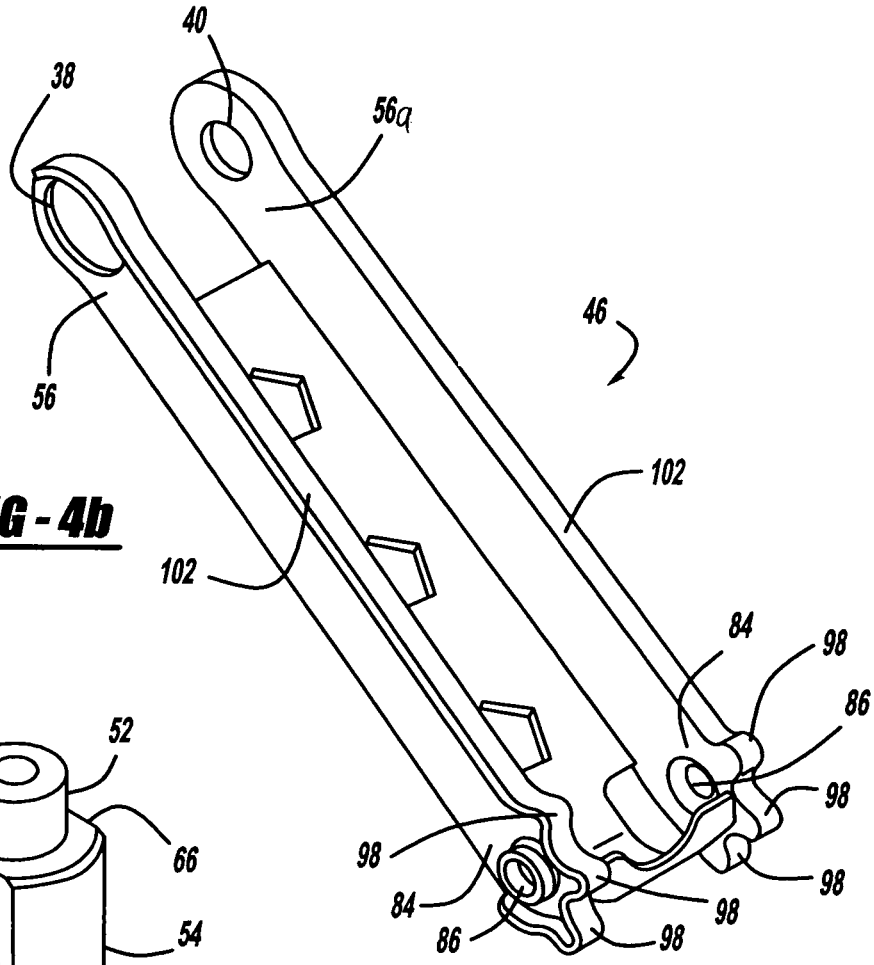
FIG. 4*b* is a perspective view of a second lower bracket used in a jack assembly, according to the present invention.
Figure 5A:
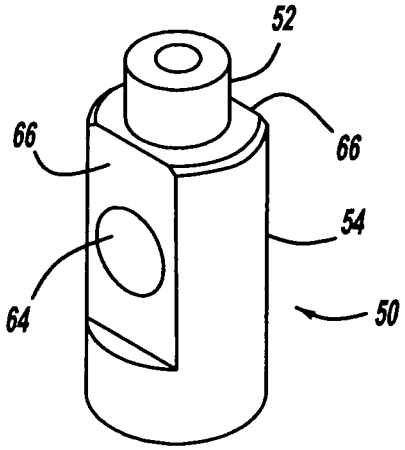
FIG. 5*a* is a side view of a trunnion used in a jack assembly, according to the present invention.
Figure 5B:
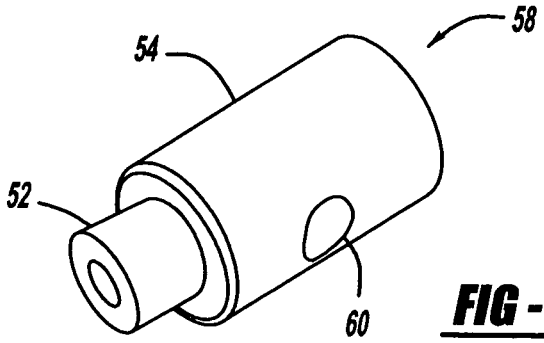
FIG. 5*b* is a perspective view of a threaded trunnion used in a jack assembly, according to the present invention.
Figure 6:
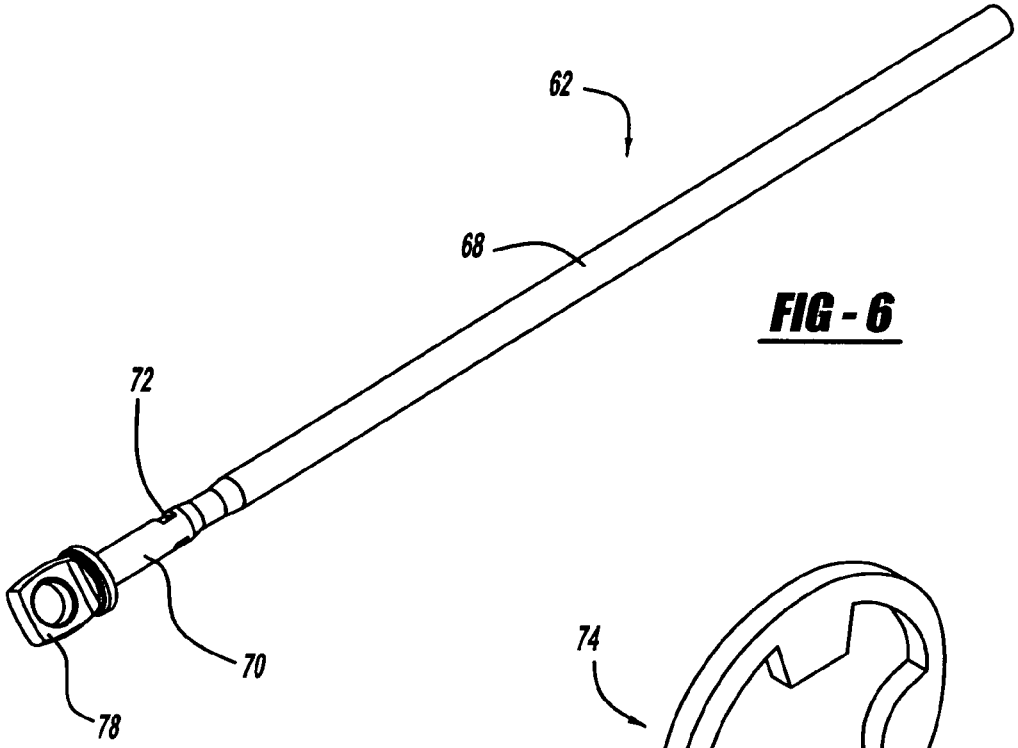
FIG. 6 is a perspective view of a lead screw used in a jack assembly, according to the present invention.
Figure 7:
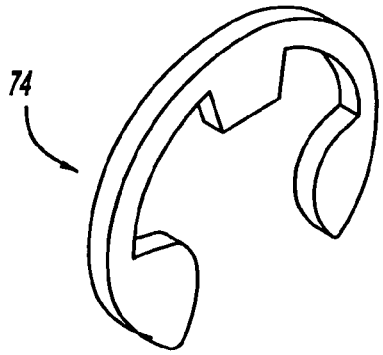
FIG. 7 is a perspective view of a clip used in a jack assembly, according to the present invention.
Figure 8:
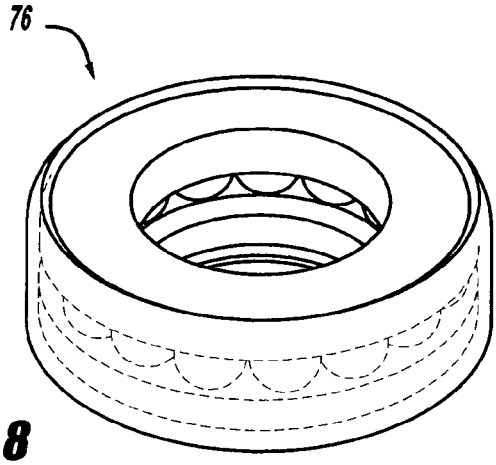
FIG. 8 is a perspective view of a bearing used in a jack assembly, according to the present invention.

Referring to the figures generally, and specifically to FIGS. 1-3, there is shown a jack assembly according to the present invention, generally at 10. The jack 10 includes a first and second upper bracket 12,14 respectively which are connected to a support member 16. The first and second upper brackets 12,14 include a first and second set of flanges 18,20 respectively, shown in FIGS. 2*a* and 2*b*, which are generally "u" shaped in cross-section. A first aperture 22,22 is surrounded by each of the flanges 18, 18*a*, which are connected by a connecting wall 19. A second aperture 24,24 is surrounded by each of the flanges 20,20*a*, which are connected by a connecting wall 21. A first set and second set of receiving apertures 26,28 are located on opposing walls of the support member 16, shown in FIG. 3. The first upper bracket 12 is pivotally connected to the support member 16 by extending a first upper pin 30 through each first aperture 22 and first set of receiving apertures 26. The second upper bracket 14 is pivotally connected to the support member 16 by extending a second upper pin 32 through each second aperture 24 and second set of receiving apertures 28. In addition, the first and second upper brackets 12,14 each have a tapered shape, along the connecting walls 19 and 21, which is narrower at the end connected to the support member 16 and wider at the opposite hinged end which are connected to lower brackets 44 and 46. This functions to improve the strength of the jack assembly 10.

Referring to the figures generally, and specifically to FIGS. 1-2*b*, the first and second upper brackets 12,14 have a plurality of teeth 34 located toward an end of the upper brackets 12,14. The plurality of teeth 34 of the first upper bracket 12 are in mesh (not illustrated) with the plurality of teeth 34 of the second upper bracket 14 to pivot the upper brackets 12,14 relative to the support member 16. The first upper bracket 12 also includes a third set of flanges 36 with one of the flanges 36 surrounding a large aperture 38 and an opposing flange 38 surrounding a small aperture 40. The second upper bracket 14 also includes a fourth set of flanges 42 with one of the flanges 42 having a large aperture 38, and another of the opposing flanges 42 having a small aperture 40.

Referring to the figures generally, and specifically to FIGS. 1-2*b* and 4*a*-5*b*, the flanges 36,42 of the first and second upper bracket 12,14 respectively are pivotally connected to a first and second lower bracket 44,46 respectively, which are generally "u" shaped in cross-section. The first and second lower brackets 44,46 each have a tapered shape, along connecting walls 45 and 47 which is wide at the connections to the base 88 and narrower at the connection to the upper brackets 12, 14, which functions to improve the strength of the jack assembly 10. The first lower bracket 44 has a fifth set of flanges 48, 48*a* wherein one of the flanges 48 surrounds a large aperture 38, and another of the opposing flanges 48 surrounds a small aperture 40. Extending through the third set of flanges 36 and the fifth set of flanges 48 is a first side pin in the form of a trunnion 50 having a stub 52 and a cap 54. The stub 52 extends through the small aperture 40 of both the third set of flanges 36 and the fifth set of flanges 48, and the cap 54 sits in the large aperture 38 of the third set of flanges 36 and the fifth set of flanges 48. The trunnion 50 is not threaded and provides a pivot connection between the first upper bracket 12 and the first lower bracket 44.

The second lower bracket 46 includes a sixth set of flanges 56, 56*a* with one of the flanges 56 surrounding a large aperture 38 and an opposing flange 56 surrounding a small aperture 40. Extending through the sixth set of flanges 56 and the fourth set of flanges 42 is a second side pin in the form of a threaded trunnion 58 having a stub 52 and a cap 54. The stub 52 extends through the small aperture 40 of both the sixth set of flanges 56 and the fourth set of flanges 42, and the cap 54 sits in the large aperture 38 of sixth set of flanges 56 and the fourth set of flanges 42. The threaded trunnion 58 provides a pivot connection between the second upper bracket 14 and the second lower bracket 46.

Referring to the figures generally, and specifically to FIGS. 1 and 5*a*-8, the threaded trunnion 58 has a threaded aperture 60 adapted to receive a threaded rod or lead screw 62. The trunnion 50 has a non-threaded aperture 64 located through a flat portion 66 of two opposing sides of the trunnion 50, and the aperture 64 is also adapted to receive the threaded rod or lead screw 62. One flat portion 66 of the outermost side of the trunnion 50 may be disposed against a bearing 76, while the opposing flat portion 66 is disposed against a retaining clip 74.

The lead screw 62 has a threaded portion 68, and a non-threaded portion 70 which is separated by a recess 72. The retaining clip 74 can be received by the recess 72 and aligned with the one flat portion 66 of the trunnion 50. The bearing 76 contacts a flange 78 that is located at an end of the non-threaded portion 70 of the lead screw 62 such that the bearing 76 is disposed between the flange 78 and the other flat portion 66 of the trunnion 50. The bearing 76, a ball bearing for example (Shown in FIG. 8), is also adapted to receive the lead screw 62 and can at least partly support an axial and radial load with respect to the lead screw 62. The clip 74 can maintain the position of the trunnion 50 and the bearing 76 between the flange 78 and the recess 72 on the non-threaded portion 70 of the lead screw 62. The non-threaded portion 70 and the bearing 76 are operably associated to facilitate rotation of the lead screw 62 relative to the trunnion 50.

Referring to the generally to FIGS. 1-10, the first lower bracket 44 has a seventh set of flanges 80 which have a set of lower bracket apertures 82. The second lower bracket 46 has an eighth set of flanges 84, each of which has a second bracket aperture 86. The first and second lower bracket 44, 46 are connected to a base 88 which rests on a ground surface during use. The base 88 has a third set of receiving apertures 90 and a fourth set of receiving apertures 92. The lower bracket apertures 82 on the seventh set of flanges 80 are aligned with the third set of receiving apertures 90 and receive a first lower pin 94, allowing the first lower bracket 44 to pivot relative to the base 88. The second bracket apertures 86 of the eighth set of flanges 84 aligns with the fourth set of receiving apertures 92, and receive a second lower pin 96, allowing the second lower bracket 46 to pivot relative to the base 88. Both the first lower bracket 44 and the second lower bracket 46 having teeth 98 which are in mesh (not illustrated) to pivot the first and second lower brackets 44,46 relative to the base 88.

In operation, a handle (not shown) is selectively connected to the flange 78. The handle can comprise a rod with a detachable hook assembly for engaging the flange 78. An extension rod can also be connected to the handle to elongate the handle to improve operator comfort and safety during operation of the vehicle jack 10. Both the detachable hook and extension rod can be connected to the handle by a pin, snap in release, and the like. The handle is manually articulated to selectively rotate the flange 78 and lead screw 62 in one of two directions. When the handle is rotated in a first direction, the threaded trunnion 58 will translate along the lead screw 62 toward the trunnion 50. This will cause the first upper bracket 12 to pivot relative to the first lower bracket 44, and cause the second upper bracket 14 to pivot relative to the second lower bracket 46 such that the support member 16 moves vertically upward along an axis extending away from the ground surface (meaning an axis vertical to the base 88). Operating the jack assembly 10 in this manner will allow the support member 16 to contact the vehicle and allow the jack assembly 10 to partly support the weight of a vehicle.

When the handle is rotated in a second direction, the threaded trunnion 58 will translate along the lead screw 62 away from the trunnion 50. This will cause the first upper bracket 12 to pivot relative to the first lower bracket 44, and the second upper bracket 14 to pivot relative to the second lower bracket 46 such that the support member 16 moves vertically downward along an axis extending vertical to the base 88. This operation is performed when weight support from the jack assembly 10 is no longer necessary and when storage of the jack assembly 10 is desired.

The teeth 34 of the first and second upper brackets 12,14 and the teeth 98 of the first and second lower brackets 44,46 allow the base 88 and the support member 16 to remain parallel to each other while the support member 16 is raised or lowered. When the jack assembly 10 is not in use, a protective case or bag (not shown) can be used to store tools such as the handle and extension rod.

Figure 9:
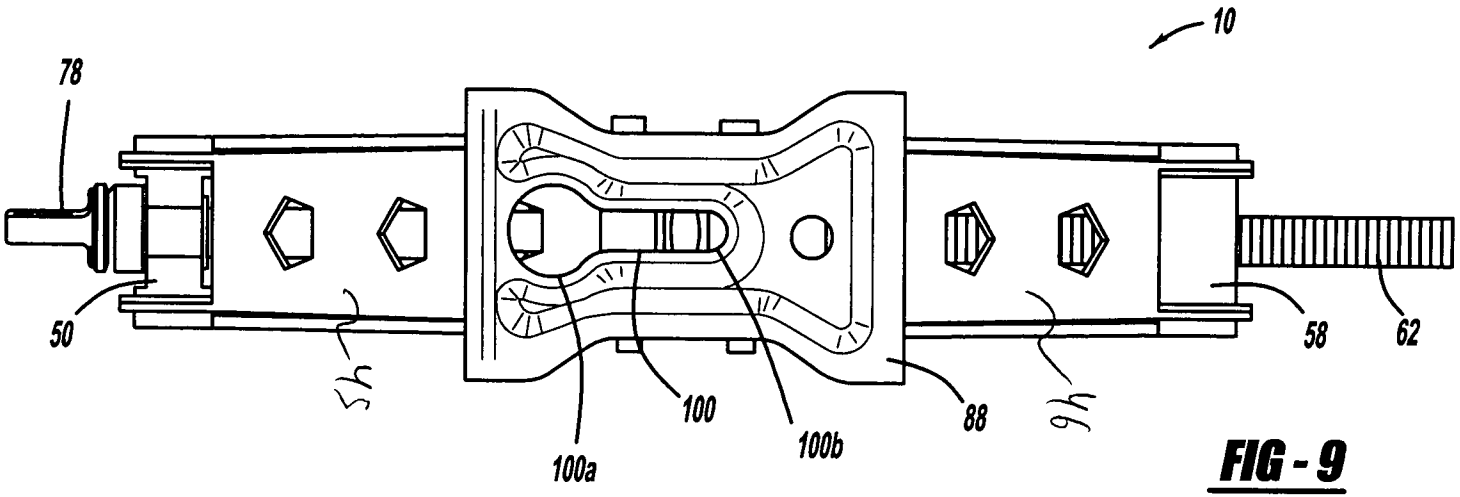
FIG. 9 is a bottom view of a jack assembly when in a collapsed position, according to the present invention.
Figure 10:
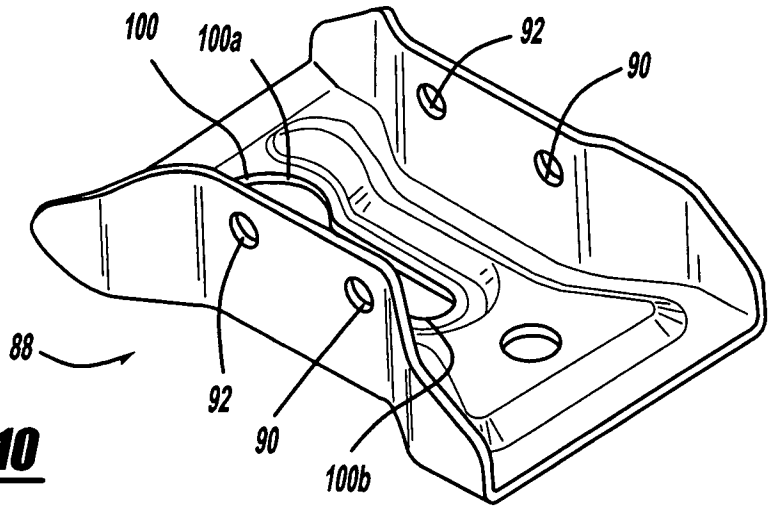
FIG. 10 is a perspective view of a base used in a jack assembly, according to the present invention.

Referring to the figures generally, and specifically to FIGS. 1 and 9-10, the base 88 comprises a fully enclosed keyhole orifice 100 which includes an enlarged opening portion 100*a* at one end of the enclosed keyhole orifice 100 and a narrower locking feature portion 100*b* extending the remainder of the enclosed keyhole orifice 100. The enclosed keyhole orifice 100 can be formed during metal stamping of the base 88 for example. For storage purposes, a vehicle (not shown) is provided with a screw bolt or stud mounting structure including an enlarged head at the end of a narrower shaft. To store the jack assembly 10, the mounting structure's enlarged head and a portion of the narrower shaft is inserted through the enlarged opening portion 100*a* of the enclosed keyhole orifice 100. The base 88 is then slid substantially parallel to the vehicle such that the diameter of the narrower shaft portion becomes positioned fully inside the narrower locking feature 100*b*, whereby the base 88 is held in place via friction. The narrower locking feature 100*b* retains the jack assembly 10 in the stored position, however, it is understood that a thumb screw or the like (not shown) can also be used to further secure the base 88 to the vehicle.

The jack assembly 10 includes additional features for improving strength. The first is a strengthening flange 102 which is formed into the outer edge of the first and second lower brackets 44,46. The strengthening flanges 102 extend substantially the entire length of the first and second lower brackets 44,46, and can also form the teeth 98 on the first and second lower brackets 44,46. The strengthening flanges 102 improve the strength of the first and second lower brackets 44,46. The second is strengthening beads 104 having rolled edges 106 located on an outermost surface of the first and second upper brackets 12,14. The strengthening beads 104 and rolled edges 106 improve the strength of the first and second upper brackets 12,14.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A jack assembly, in particular a jack assembly for a motor vehicle comprising:

first and second upper brackets forming elongated downwardly open channels with spaced opposing sides, said first and second upper brackets are pivotally connected to a support member and tapered for strength, said first and upper brackets include at least one strengthening bead having rolled edges extending longitudinally along said spaced opposing sides of said first and second upper brackets respectively for strengthening said first and second upper brackets;

an inwardly extending flange for strength formed along a longitudinal outer edge of said spaced opposed sides of said first and second upper brackets respectively and forming a plurality of teeth at an upper end of said first and second upper brackets respectively that are in mesh with one another;

first and second lower brackets forming elongated upwardly open channels with upwardly extending spaced opposing sides, said first and second lower brackets are tapered for strength and include at least one strengthening flange;

said at least one strengthening flange extending along the entire longitudinal length of an upwardly located outer edge of said opposing sides of said first and second lower brackets respectively for strengthening said first and second lower brackets, wherein said at least one strengthening flange is configured to extend outwardly along said outer edges and form a plurality of teeth at a lower end of said first and second lower brackets respectively that are in mesh with one another, and configured to substantially encircle the top of a cap of a first and second side pins respectively to provide strength at joints where said first and second side pin pivotally connect said first and second lower brackets and said first and second upper brackets respectively;

raised bosses formed on said spaced opposing sides and located at lower ends of said first and second lower brackets, wherein said raised bosses are shaped and configured to receive a first and second lower pin through an aperture respectively to pivotally connect said first and second lower brackets to a jack base configured to rest on a ground surface as at least one vehicle wheel is lifted from said ground surface;

a rotatable threaded rod extending through said first side pin and said second side pin to cause said first upper bracket to pivot relative to said support member and said first lower bracket, said second upper bracket to pivot relative to said support member and said second lower bracket, and said support member to move either away from said jack base or toward said jack base when said threaded rod is rotated; and an enclosed keyhole orifice disposed on said jack base for mounting to said motor vehicle, wherein said enclosed keyhole orifice includes a larger entry portion and a narrower retention portion adapted for receiving a narrower shaft portion and a wider end portion of a vehicle mounting structure through said larger entry portion and retaining said narrower shaft portion within said narrower retention portion of said enclosed keyhole orifice to hold said jack assembly in a stored position by friction.

2. The invention according to claim 1, wherein said second side pin is a trunnion.

3. The invention according to claim 1, wherein said first side pin is a trunnion.

4. The invention according to claim 3, further comprising a non-threaded aperture for receiving said threaded rod.

5. The invention according to claim 1, further comprising a bearing operably associated with said first side pin and adapted to receive said threaded rod for partly supporting an applied load force relative to said threaded rod.

6. The invention according to claim 1, further comprising a detachable elongated handle operably connected to said threaded rod for manual rotation of said threaded rod.

7. A jack assembly, in particular a jack assembly for a motor vehicle comprising:

first and second upper brackets forming elongated downwardly open channels with spaced opposing sides, said first and second upper brackets are pivotally connected to a support member and tapered for strength, said first and upper brackets include at least one strengthening bead having rolled edges extending longitudinally along said spaced opposing sides of said first and second upper brackets respectively for strengthening said first and second upper brackets;

an inwardly extending flange for strength formed along a longitudinal outer edge of said spaced opposed sides of said first and second upper brackets respectively and forming a plurality of teeth at an upper end of said first and second upper brackets respectively that are in mesh with one another;

a first transverse flange formed on said upper end of said first and second upper brackets respectively that is substantially transverse to the longitudinal axis of said spaced opposing sides and extends adjacent to said teeth for strengthening said pivotal connection of said first and second upper brackets to said support member;

first and second lower brackets forming elongated upwardly open channels with upwardly extending spaced opposing sides, said first and second lower brackets are tapered for strength and include at least one strengthening flange;

said at least one strengthening flange extending along the entire longitudinal length of an upwardly located outer edge of said opposing sides of said first and second lower brackets respectively for strengthening said first and second lower brackets, wherein said at least one strengthening flange is configured to extend outwardly along said outer edges and form a plurality of teeth at a lower end of said first and second lower brackets respectively that are in mesh with one another, and configured to substantially encircle and directly abut the top of a cap of a first and second side pins respectively to provide strength at joints where said first and second side pins pivotally connect said first and second lower brackets and said first and second upper brackets respectively;

raised bosses formed on said spaced opposing sides and located at lower ends of said first and second lower brackets, wherein said raised bosses are shaped and configured to receive a first and second lower pin through an aperture respectively to pivotally connect said first and second lower brackets to a lack base configured to rest on a ground surface as at least one vehicle wheel is lifted from said ground surface;

a second transverse flange formed on said lower end of said first and second lower brackets respectively that is substantially transverse to the longitudinal axis of said opposing sides and extends adjacent to said teeth for strengthening said pivotal connection of said first and second lower brackets to said jack base;

a rotatable threaded rod extending through said first side pin and said second side pin;

a bearing operably aligned with said first side pin and adapted to also receive said threaded rod that rotates in a first direction or a second direction to move said support member either away from said jack base or toward said jack base, wherein said bearing at least partly supports a load with respect to said threaded rod; and a fully enclosed keyhole orifice disposed on said jack base including a larger entry portion and a narrower retention portion adapted for receiving a narrower shaft and a wider end portion of a vehicle mounting structure through said larger entry portion and retaining said narrower shaft portion within said narrower retention portion of said fully enclosed keyhole orifice to hold said jack assembly in a stored position by friction.

8. The invention according to claim 7, wherein said bearing is a ball bearing.

9. The invention according to claim 7, further comprising a detachable elongated handle operably connected to said threaded rod for manual rotation of said threaded rod.

10. A method for storing a jack assembly comprising:

providing first and second upper brackets forming elongated downwardly open channels with spaced opposing sides, said first and second upper brackets are pivotally connected to a support member and tapered for strength, said first and upper brackets include at least one strengthening bead having rolled edges extending longitudinally along said spaced opposing sides of said first and second upper brackets respectively for strengthening said first and second upper brackets;

providing an inwardly extending flange for strength formed along a longitudinal outer edge of said spaced opposed sides of said first and second upper brackets respectively and forming a plurality of teeth at an upper end of said first and second upper brackets respectively that are in mesh with one another;

providing first and second lower brackets forming elongated upwardly open channels with upwardly extending spaced opposing sides, said first and second lower brackets are tapered for strength and include at least one strengthening flange;

said at least one strengthening flange extending along the entire longitudinal length of an upwardly located outer edge of said opposing sides of said first and second lower brackets respectively for strengthening said first and second lower brackets, wherein said at least one strengthening flange is configured to extend outwardly along said outer edges and form a plurality of teeth at a lower end of said first and second lower brackets respectively that are in mesh with one another, and configured to substantially encircle the top of a cap of a first and second side pins respectively to provide strength at joints where said first and second side pin pivotally connect said first and second lower brackets and said first and second upper brackets respectively;

providing raised bosses formed on said spaced opposing sides and located at lower ends of said first and second lower brackets, wherein said raised bosses are shaped and configured to receive a first and second lower pin through an aperture respectively to pivotally connect said first and second lower brackets to a jack base configured to rest on a ground surface as at least one vehicle wheel is lifted from said ground surface;

providing a rotatable threaded rod extending through said first side pin and said second side pin;

providing a fully enclosed keyhole orifice on a jack base, said enclosed keyhole orifice including an enlarged opening portion and a narrower retention portion adapted for receiving a narrower shaft and a wider end portion of a vehicle mounting structure through said larger entry portion and retaining said narrower shaft portion within said narrower retention portion of said fully enclosed keyhole orifice to hold said jack assembly in a stored position by friction;

rotating said rotatable threaded rod in a second direction to cause said second side pin to translate along said rotatable threaded rod away from said first side pin to cause said first upper bracket to pivot relative to said support member and said first lower bracket, said second upper bracket to pivot relative to said support member and said second lower bracket, and said support member to move toward said jack base to position said jack assembly in a storable position;

aligning said enlarged opening portion with said vehicle mounting structure, and passing said enlarged opening portion partly over said wider end portion and said narrower shaft portion of said mounting structure; and moving said jack base substantially parallel to said vehicle until said narrower shaft portion is retained within said narrower retention portion of said enclosed keyhole orifice to hold said jack assembly in a stored position by friction.

11. The invention according to claim 10, further comprising a first transverse flange formed on said upper end of said first and second upper brackets respectively that is substantially transverse to the longitudinal axis of said spaced opposing sides and extends adjacent to said teeth for strengthening said pivotal connection of said first and second upper brackets to said support member.

12. The invention according to claim 10, further comprising a second transverse flange formed on said lower end of said first and second lower brackets respectively that is substantially transverse to the longitudinal axis of said opposing sides and extends adjacent to said teeth for strengthening said pivotal connection of said first and second lower brackets to said jack base.

13. The invention according to claim 10, wherein said at least one strengthening flange directly abuts against the top of said cap of said first and second side pins respectively to provide strength at said joints.

14. The invention according to claim 10, wherein said first and second side pins extend substantially transverse to said rotatable threaded rod.

15. The invention according to claim 1, further comprising a first transverse flange formed on said upper end of said first and second upper brackets respectively that is substantially transverse to the longitudinal axis of said spaced opposing sides and extends adjacent to said teeth for strengthening said pivotal connection of said first and second upper brackets to said support member.

16. The invention according to claim 1, further comprising a second transverse flange formed on said lower end of said first and second lower brackets respectively that is substantially transverse to the longitudinal axis of said opposing sides and extends adjacent to said teeth for strengthening said pivotal connection of said first and second lower brackets to said jack base.

17. The invention according to claim 1, wherein said at least one strengthening flange directly abuts against the top of said cap of said first and second side pins respectively to provide strength at said joints.

18. The invention according to claim 1, wherein said first and second side pins extend substantially transverse to said rotatable threaded rod.

* * * * *